United States Patent [19]

Mair

[11] Patent Number: 4,956,900

[45] Date of Patent: Sep. 18, 1990

[54] FASTENING DEVICE

[76] Inventor: Bernard Mair, 1141 Burmac Dr., Unit 9, Weston, Ontario, Canada, M2H 1X4

[21] Appl. No.: 333,215

[22] Filed: Apr. 5, 1989

[51] Int. Cl.[5] ..... A44B 11/25

[52] U.S. Cl. ..... 24/606; 411/349; 403/406.1

[58] Field of Search ..... 24/606, 607, 691, 72.7; 411/349; 403/406.1

[56] References Cited

U.S. PATENT DOCUMENTS

| | | | |
|---|---|---|---|
| 1,232,733 | 7/1917 | Swedlund | 24/606 |
| 2,494,159 | 1/1950 | Bernstein | 24/606 |
| 3,964,364 | 6/1976 | Poe | 411/349 |
| 4,373,826 | 2/1983 | Inamoto et al. | 403/406.1 |
| 4,498,827 | 2/1985 | Mair | 411/349 |
| 4,762,437 | 8/1988 | Mitomi | 411/349 |

*Primary Examiner*—Victor N. Sakran

*Attorney, Agent, or Firm*—Kenneth M. Garrett

[57] ABSTRACT

A lockable latch comprises an outer cylinder part and an inner part mounted coaxially within the cylinder for movement between first and second position which lock and unlock the latch. One of the outer and inner parts includes a resilient tongue forming part of the radial wall surface thereof, the tongue having a latching projection formed thereon. The other of the parts has a gate opening in the radial wall surface thereof, the tongue and the gate opening being in register to unlock the latch, and out of register to lock the latch. The two parts may each be unitarily molded in plastic material.

20 Claims, 2 Drawing Sheets

FASTENING DEVICE

FIELD OF INVENTION

This invention relates to a lockable latch. It particularly relates to a latch that is easily manufactured in thermoplastic materials.

BACKGROUND OF INVENTION

In my U.S. Pat. No. 4,498,827 there is described a turnbuckle device which finds wide use for retaining tarpaulins or the like in position. In such use the tarpaulin is provided with a grommet having an elongated opening through which the head of the turnbuckle may be passed when aligned with the major axis of the grommet, and which is trapped when the head is rotated through 90 degrees. Elongated grommets of the foregoing nature must be specifically manufactured and applied to the tarpaulin, whereas round grommets are relatively cheap and more readily applied.

SUMMARY OF INVENTION

This invention in one form thereof particularly provides a lockable latch which is suited for releasably retaining round grommets or the like, although it has a much wider application as a lockable latching device.

In accordance with one aspect of the invention, a lockable latch comprises an outer cylindrical member, and an inner member mounted coaxially within the outer member for relative movement on the coaxis between first and second positions. One of the members is provided with a resilient tongue in the radial wall thereof, and the other member is provided with an opening in the radial wall. In the first position the tongue and opening are in register, whereby the tongue may be resiliently deformed into the opening. In the second position the tongue is in contact with the radial wall surface of the other member, thereby precluding the resilient movement of the tongue towards the second member. The tongue is provided at the distal end thereof, on the surface remote from the other member, with a latching projection that will act to trap a shoulder associated with a part to be latched.

In the event that the outer of the pair of members is provided with the latching tongue, the latch is particularly suited for releasably latching a grommet. In the event that the inner of the pair of members is provided with the latching tongue, the latch is particularly suited for latching a post or the like which enters the inner of the members, which will be understood to be hollow to permit the entry of the post.

Conveniently, and in accordance with the preferred embodiment, the relative movement of the pair of members will be rotational, about their common axis, although linear or helical movement is also contemplated.

The latch will normally include means for retaining the pair of members in their mounted relationship. Suitably such means may form coacting parts of the unitary structure of the members, which snap fit together.

Preferably the latching projection on the tongue has a profile in the form of a double ramp surface, such that the part to be latched, as it moves either into or out of latching engagement with the latch in its unlocked state, exerts a biasing force on the tongue that will deflect the tongue to permit the part to enter into latching engagement, or to be released therefrom, as the case may be.

The members are particularly amendable to being unitarily molded from a thermoplastic material; the members may be readily provided with a plurality of latching tongues and mating openings of the foregoing nature, without appreciable increase in manufacturing costs.

These foregoing objects and aspects of the invention, together with other objects, aspects and advantages thereof will be more apparent from the following description of a preferred embodiment thereof, taken in conjunction with the following drawings.

DESCRIPTION OF THE PREFERRED EMBODIMENT

Figure 1:
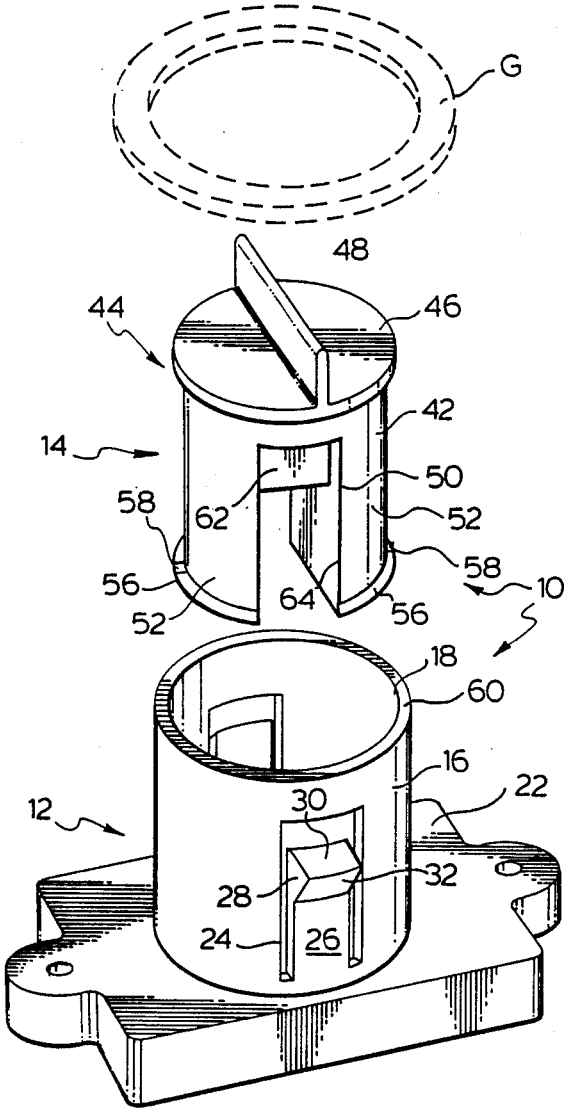
FIG. 1 shows in exploded perspective view the component parts of one embodiment of a lockable latch in accordance with the invention, with a grommet G shown in dashed outline for securement thereby.

Referring to the drawings in detail, a lockable latch in accordance with a first embodiment of the invention is identified in FIG. 1 by the numeral 10. Latch 10 comprises two parts, namely latching part 12 and locking part 14, each of which is susceptible to being unitarily molded from a thermoplastic material.

Latching part 12 includes a tubular wall 16 defining a circular bore 18, and a base 22 from which wall 16 is upstanding. Wall 16 has an inverted, U shaped slot 24 therein to define a tongue 26 rooted adjacent base 22. Tongue 26 has a radially outwardly directed latching projection 28 thereon, which projection has a double ramp profile comprising a downwardly outwardly sloping upper ramp surface 30 and an upwardly outwardly sloping lower ramp surface 32.

Figure 2:
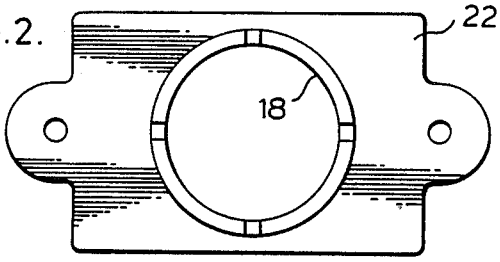
FIG. 2 is a plan view from below of the device of FIG. 1.

Latching part 12 has a two-fold plane of symmetry, the structure of the obverse side of the part, as seen in FIG. 1, being also found on the reverse side of the part. As seen in FIG. 2, bore 18 is generally uniform along its length, but is somewhat enlarged at shoulder 34, which locates adjacent the intersection of wall 16 and base 22. Shoulder 34 is provided with detent grooves 40 therein.

Locking part 14 comprises a cylindrical post 42 having a diameter marginally less than that of bore 18, so as to be freely rotatable therein. Post 42 is surmounted by a handle 44 including a disk-like portion 46 having a diameter equal to the external diameter of cylindrical wall 16, and a grasping bar portion 48 upstanding thereon.

Post 42 has a pair of diametrically opposed gate openings 50 therein, which openings extend to the lower margin of the post and are in communication, in effect forming a pair of resiliently sprung jaws 52. The margins defining openings 50 are approximately the same as those defining U shaped slot 24.

Post 42 is provided with a small, outwardly facing lip 56 adjacent the lower end thereof. Lip 56 has pair of opposed detent shoulders 58 thereon arranged on a diameter at right angles to that on which handle bar portion 48 and opposed gate openings 50 reside, whereby the bar portion provides an indication of the rotational position of locking part 14.

Locking part 14 is assembled with latching part 12 by exerting a force to partially collapse jaws 52, whereby lips 56 will enter into bore 18. The parts are proportioned such that when disk portion 46 contacts the upper peripheral edge 60 of wall 16, lips 56 will snap behind shoulder 34, to thereby retain the parts 12 and 14 in axial position. Detent grooves 40 and detent shoulders 58 are located such that they engage when parts 12 and 14 locate in a first rotational position when tongue 26 is in register with opening 50, or a second position at right angles thereto. In the first position, tongue 26 is free to be resiliently deformed rearwardly into opening 50. Such deformation will permit a grommet G shown in dashed outline in FIG. 1 to enter into latching engagement with latch 10. As grommet G is offered to latch 10, its downward motion will be translated by upper ramp surface 30 to bias tongue 26 inwardly, and thereby permit the grommet to be latched between latching projection 28 and base 22. Conversely, a latched grommet G will be released as it is urged upwardly, the upward force being translated by lower ramp surface 32 to bias tongue 26 inwardly.

When locking part 14 is rotated through 90 degrees to its second, locking position, jaws 52 underlie tongues 26 to preclude their inward movement, whereby a component such as grommet G latched by latching shoulder 28 will be locked into position.

It will be remarked that jaws 52 are resiliently sprung to permit the parts 12 and 14 to be assembled, and that accordingly a strong rearward force applied to latch shoulders 28 could bias not only tongue 26, but also jaws 52 therewith, to release a latched component such as grommet G even though latch 10 is in its locked configuration. For this purpose there is provided a reinforcing wall 62, which extends between upper parts of jaws 52 and which restrict the inward deflection thereof. Wall 62 also serves to limit the inward deflection of tongue 26 when latch 10 is unlocked.

A further feature of latch 10 is seen in parallel walls 64, which interconnect radially opposed margins of openings 50, to form a nonhanging passageway 64 therebetween. By "non-hanging passageway" it is intended to mean that the width of the passageway, at least where it is adjacent to openings 50, is relatively uniform thereby precluding tongue 26 from being inadvertently trapped by post 42.

Figure 3:
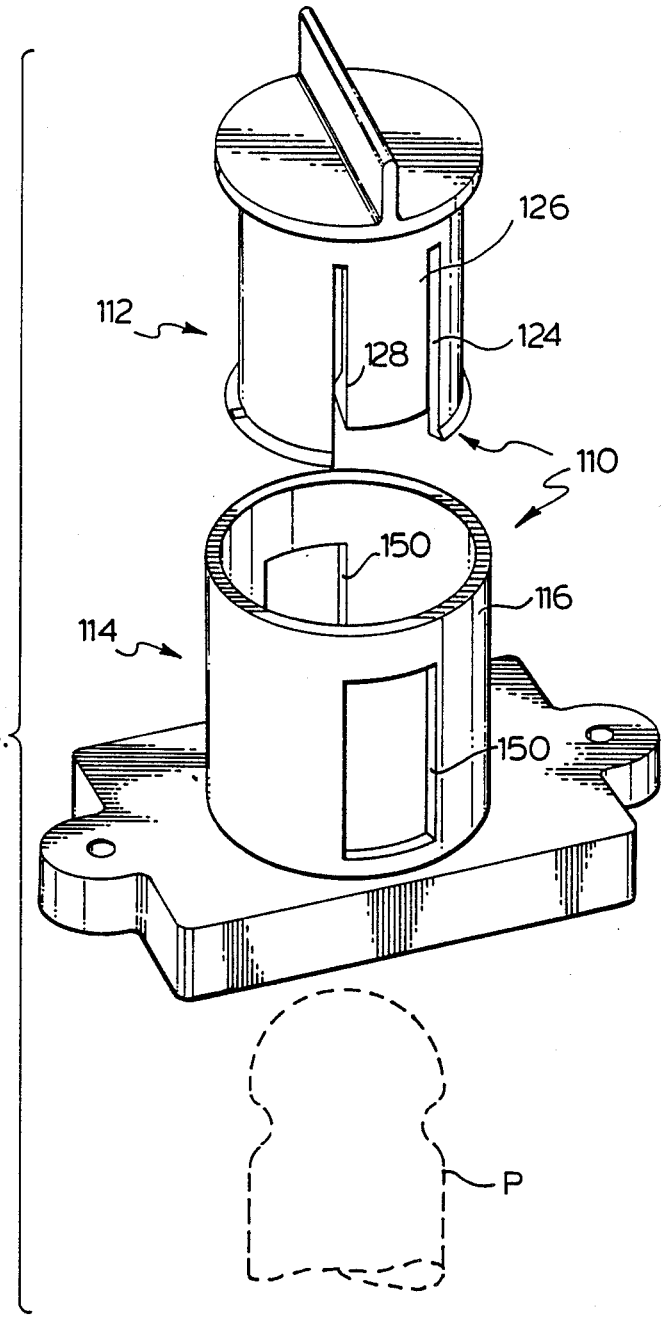
FIG. 3 is similar to FIG. 1 but shows a second embodiment of the invention for use with a pin P shown in dashed outline.

In a second embodiment of the invention as seen in FIG. 3 a locking latch 110 comprises a latching part 112 and a locking part 114. Locking part 112 comprises a cylindrical wall 116 having diametrically opposed wall openings 150 therein. Latching part 114 includes a hollow cylindrical post 142 slotted at 124 to form a tongue 126. Tongue 126 is provided with a double ramped latching shoulder 128. It will be understood that latching part 112 preferably has a plane of symmetry, and that a second latching tongue 128 will also locate in the obverse side of latching part 112. It will also be understood that parts 112 and 114 assemble together and function in combination in a similar manner to latch 10 to latch and lock for example a component such as a pin P.

It will be apparent that many changes may be made to the illustrative embodiment, while falling within the scope of the invention and it is intended that all changes be covered by the claims appended hereto.

I claim:

1. A lockable latch comprising:

an outer cylindrical member and an inner member mounted coaxially within said cylindrical member for relative coaxial movement between first and second positions respectively defining unlocked and locked latch positions;

one of said members including a resilient tongue forming part of the radial wall surface thereof;

the other of said members having an opening in the radial wall surface thereof;

said tongue and said opening being in register when said members are in said first position to permit said tongue to be deformed into said opening, said tongue and said opening being out of register when said members are in said second position whereby said tongue is blocked by contiguous portions of said other member; and a latching projection formed on distal portions of said tongue facing away from said other member.

2. A lockable latch as defined in claim 1, wherein said tongue is formed on said outer member.

3. A lockable latch as defined in claim 2, wherein said relative movement is a rotational movement about said coaxis.

4. A lockable latch as defined in claim 3, wherein said members are provided with coacting elements which retain the members in mounted relationship.

5. A lockable latch as defined in claim 3, wherein said latching projection is formed with a double ramp surface.

6. A lockable latch as defined in claim 4, wherein said coacting element are unitarily formed on said members.

7. A lockable latch as defined in claim 4, wherein said members are provided with detent means for locating said members in said first and second positions.

8. A lockable latch as defined in claim 7, wherein said detent means are unitarily formed on said members.

9. A lockable latch as defined in claim 2, wherein said outer member is provided with a second tongue and said inner member with a second opening, said tongues and said openings respectively being in diametric opposition.

10. A lockable latch comprising an outer cylindrical member and an inner member coaxial therewith;

means mounting said inner member to permit rotation about the coaxis while restraining axial movement;

said cylindrical member having an inverted U shape slot in the cylindrical wall thereof to define a tongue;

an outwardly facing latching projection locating adjacent the distal end of said tongue;

said inner member including a head and jaws depending from said head having an opening therebetween;

said inner member when rotated to a first, unlocked position having said opening in register with said tongue to permit an inward, resilient movement of said tongue;

said inner member when rotated to a second, locked position having a jaw portion underlaying said tongue to restrain said resilient movement.

11. A lockable latch as defined in claim 10, wherein said jaws are resiliently deformable adjacent the lower ends thereof, and further comprising reinforcing wall means locating within said opening adjacent the upper end of said jaws to restrict the resilient movement thereof.

12. A lockable latch as defined in claim 11, wherein said means mounting said inner member comprises a lip locating adjacent the lower end of said jaws which coacts with means associated with said cylindrical member.

13. A lockable latch as defined in claim 12, wherein said members are provided with detent means to locate said first and second positions.

14. A lockable latch as defined in claim 10, wherein said head includes a handle means, and said handle means forms an indicator of the rotational position of said inner member.

15. A lockable latch as defined in claim 14, wherein said head has a planform within that of said cylindrical member.

16. A lockable latch as defined in claim 10, wherein said cylindrical member is mounted from a base.

17. A lockable latch as defined in claim 10, wherein said latching projection is formed with a double ramp surface.

18. A lockable latch as defined in claim 10, wherein said inner member is provided with a second opening radially opposed to said opening, and wherein wall means interconnects said opposed openings to form a non-hanging passageway therebetween.

19. A lockable latch comprising an outer cylindrical member and an inner member coaxial therewith;

means mounting said members for relative rotation about their coaxis between first and second positions while restraining linear movement thereof;

said outer member having an opening in the wall thereof, said inner member having a flexible tongue portion unitarily formed therewith;

an inwardly facing latching projecting locating adjacent the distal end of said tongue;

said tongue and said opening being in register when said members are in said first position to permit said tongue to be deflected into said opening, and cylindrical wall portions overlaying said tongue when said members are in said second position to thereby lock said latch.

20. A lockable latch as defined in claim 19, wherein said latching projection is formed with a double ramp surface.

* * * * *